United States Patent [19]

Black et al.

[11] Patent Number: 4,753,577

[45] Date of Patent: Jun. 28, 1988

[54] FLUID POWERED RETRIEVABLE DOWNHOLE PUMP

[75] Inventors: John B. Black; Stanford A. Smith, Jr.; Robert C. Toups, all of Lafayette, La.

[73] Assignee: Robert F. Wright, Lafayette, La.

[21] Appl. No.: 926,333

[22] Filed: Nov. 3, 1986

[51] Int. Cl.[4] ..... F04F 5/00

[52] U.S. Cl. ..... 417/172; 417/195

[58] Field of Search ..... 417/172, 195, 198, 151

[56] References Cited

U.S. PATENT DOCUMENTS

| | | | |
|---|---|---|---|
| 2,080,624 | 5/1937 | McMahon | 417/172 X |
| 2,114,905 | 4/1938 | McMahon | 417/172 |
| 2,915,987 | 12/1959 | McMahon | 417/195 |
| 4,135,861 | 1/1979 | Brown et al. | 417/195 X |
| 4,183,722 | 1/1980 | Roeder | 417/172 |
| 4,285,638 | 8/1981 | Clark | 417/172 |
| 4,293,283 | 10/1981 | Roeder | 417/172 |
| 4,504,195 | 3/1985 | Binks et al. | 417/172 |
| 4,658,893 | 4/1987 | Black | 417/172 X |
| 4,664,603 | 5/1987 | Priestly | 417/172 |

FOREIGN PATENT DOCUMENTS

| | | | |
|---|---|---|---|
| 823658 | 4/1981 | U.S.S.R. | 417/172 |
| 1103022 | 7/1984 | U.S.S.R. | 417/172 |
| 1161724 | 6/1985 | U.S.S.R. | 417/172 |

OTHER PUBLICATIONS

H. L. Petrie et al., "Jet Pumping Oil Wells," *World Oil,* Nov. 1983.

*Primary Examiner*—Carlton R. Croyle
*Assistant Examiner*—Paul F. Neils
*Attorney, Agent, or Firm*—Guy E. Matthews

[57] ABSTRACT

A jet pump system including a pump body having a nozzle carrier, a pump housing, and a cross-over housing connected in axially alignment. A flow discharge housing extends from the cross-over housing up to near the nozzle carrier. An injector nozzle having a cylindrical injection bore is axially directed into the discharge housing. A mixing tube is carried by the discharge housing which has a mixing bore in alignment with the injector bore. A funnel shaped flow intake throat merges through a mixing throat into the mixing bore. The cross-over housing is formed with large flow windows for discharge of the pumped mixed fluid through equally large windows, formed in a tubing seating sub into the annulus between the tubing and casing of a well. The assembly is equipped to be pumped down into operating position and pumped back to the earth's surface.

12 Claims, 2 Drawing Sheets

FLUID POWERED RETRIEVABLE DOWNHOLE PUMP

FIELD OF THE INVENTION

This invention generally relates to the pumping of oil wells with subsurface pumps and more particularly pertains to an improved jet pump having straight through high velocity flow passageways with otherwise large flow areas for greatly improved hydraulic efficiency.

BACKGROUND OF THE INVENTION

Subsurface or downhole jet pumps are in increasing use in the pumping of oil wells. In more recent installations of this type, well tubing is installed in a well bore, usually with a production packer, and the jet pump assembly is pumped down the tubing into place, utilized to pump oil produced by the well formation, and later retrieved by reverse circulation to pump the jet pump assembly back to the earth's surface. The principle need in pump installations of this kind is to increase pump efficiency and thereby to pump a maximum amount of oil from a well with a designated amount of hydraulic power generated at the earth's surface.

Presently known prior art showing jet pump installations and jet pumps of this kind are disclosed in U.S. Pat. Nos. 2,080,623; 2,08O,624; 2,114,905; 4,183,722; 4,293,283; and 4,518,036. Another jet pump installation of this kind is shown on pages 5767–68 of the *Composite Catalogue of Oil Field Equipment and Services* (1984–1985 Edition) published by World Oil, Houston, Texas.

OBJECTS OF THE INVENTION

The principle object of the present invention is to provide a downhole jet pump of improved hydraulic efficiency attained with straight through high velocity hydraulic passageways and otherwise large area flow passageways with a minimum of directional change in fluid flow.

Another object of the invention is to provide a jet pump which may be utilized in a pump-down pumping assembly and also used at the earth's surface in other piping arrangements as a surface production booster, a tubing pump and the like.

SUMMARY OF THE INVENTION

The foregoing and other objects and advantages are attained in a jet pump adapted for connection into well tubing to pump the fluids produced into a well casing. The pump includes a pump body having a generally tubular jet nozzle carrier, a generally tubular pump housing, and an elongated flow cross-over housing all connected in threaded connection and adapted for threaded connection into other tubular members. A generally tubular flow discharge housing is connected within the pum housing to extend from the cross-over housing to near the nozzle carrier. An injector nozzle assembly including a nozzle liner having a cylindrical injection bore is connected to the nozzle carrier and axially directed into the discharge housing. A mixing tube having a cylindrical mixing bore is connected to the flow discharge housing in axial alignment with the injection bore. A funnel shaped annular flow intake throat is formed between the outlet of the injection nozzle and the inlet of the mixing tube. A frusto-conical mixing throat is formed by the inlet of the mixing tube merges into the intake throat and the mixing tube bore to form a common passageway. A diverging pressure recovery diffusion bore is formed within the discharge housing to extend in axial alignment between the mixing bore and a discharge chamber formed within the cross-over housing. An annular intake passageway is defined between the pump housing and the discharge housing. A plurality of intake ports are formed within the cross-over housing which open into the annular chamber and generally extend circumferentially around and past the discharge chamber into a generally cylindrical passageway formed by the cross-over housing in axial alignment with the discharge housing. A plurality of housing window passageways are formed between the intake ports to open the diffusion bore through the discharge chamber to outside the pump body. The cross-over housing is adapted to be received into a tubing seating collar which is connected into the tubing. The seating collar defines a plurality of tubing window passageway openings between the housing window passageways and the annulus between the tubing and the well casing whereby well fluids discharged by the pump passes into the casing and on to the earth's surface with a minimum of pressure drop.

BRIEF DESCRIPTION OF THE PREFERRED EMBODIMENT

Figure 6:
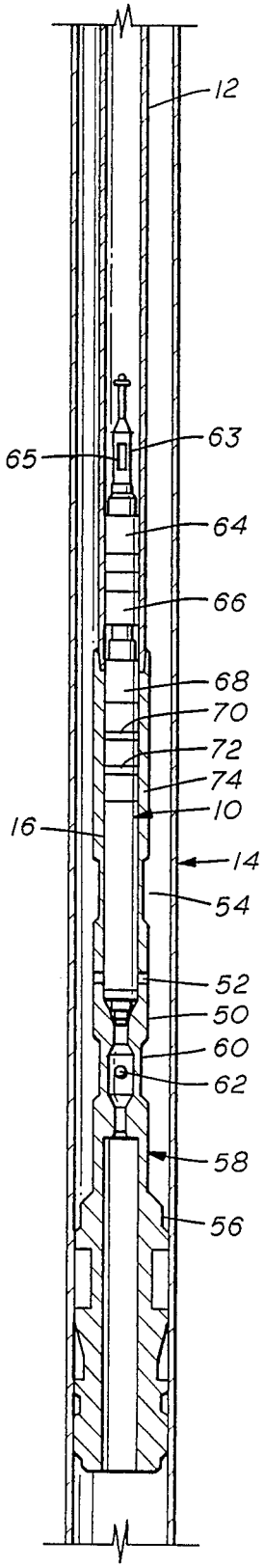
FIG. 6 is the same view as FIG. 5 and showing the jet pump assembly seated into place and in pumping mode.

Referring now to the drawing and first to FIG. 6, there is shown a jet pump assembly IO of the present invention as seated within well tubing 12 with the well tubing seated into a production packer 56 set within well casing 14. The lower end of tubing 12 has mounted thereon a jet pump receiving assembly 58 which includes a stinger (not shown) a foot valve sub 60, containing a foot valve 62, and a pump seating collar 50.

Figure 1:
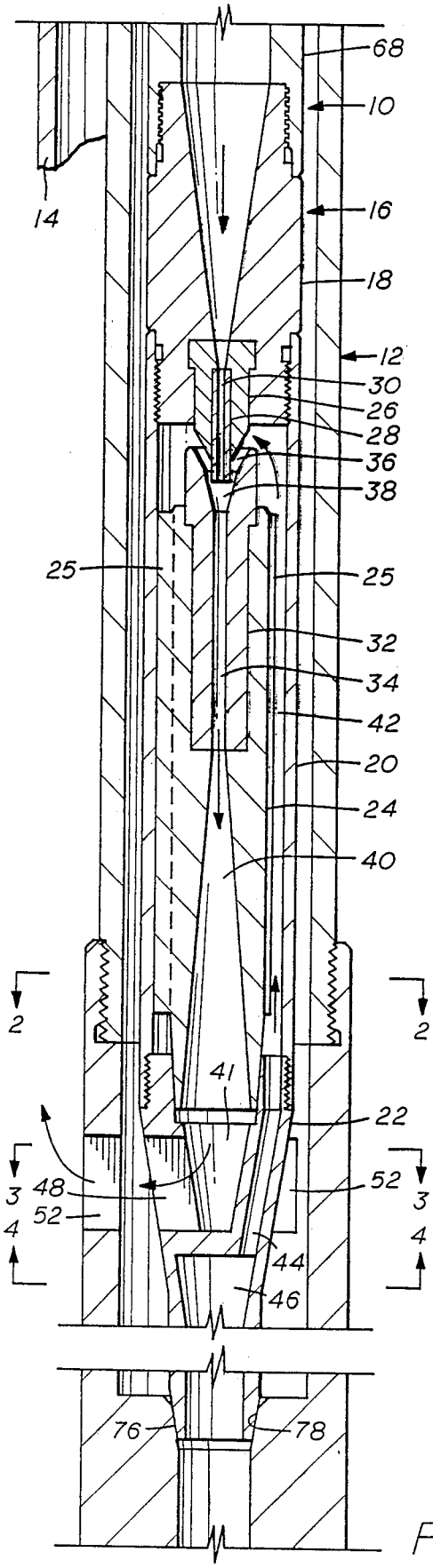
FIG. 1 is a longitudinal cross sectional view of the jet pump of the present invention as installed in well tubing.

The jet pump assembly 10 includes a fishing neck assembly 63, a pump cup assembly including an upwardly opening cup 64 and a downwardly opening cup 66, and a sealing sub 68 having seals 70 and 72 which establish a seal within a seal collar 74 connected into the tubing string as shown. A plurality of ports 65 admit high pressure liquid into the assembly 10. The sealing sub 68 is connected to the nozzle carrier 18 of the pump body 16 as shown in FIG. 1. The pump body 16 is seen to include a generally tubular jet nozzle carrier 18, a generally tubular pump housing 20 and an elongated flow cross-over housing 22 threadedly connected into the assembly as shown in FIGS. 1–4.

Mounted within the pump housing 20 in threaded connection with the upper end of the cross-over housing 22 is a discharge housing 24 which is connected by vanes 25 with housing 20 as shown to extend upwardly from the cross-over housing to near the nozzle carrier 18. The nozzle carrier 18 carries an injector nozzle assembly 26 including a nozzle liner 28 having an injection bore 30 axially aligned within the body 16. The nozzle liner 28 and bore 30 is axially directed into the discharge housing and the axis of a mixing tube 32 which defines a cylindrical mixing bore 34.

The intake nozzle assembly 26 and the upper end of the mixing tube 32 define a funnel shaped space or flow mixing bore 36 which merges in with a frusto-conical mixing throat 38 which is defined by the inlet of the mixing tube and merges with the intake throat. Within the flow discharge housing 24 the mixing bore 34 merges into a diffusion bore 40 formed within the discharge housing which extends in axial alignment between the mixing bore and a discharge chamber 41 which is formed within the cross-over housing 22.

As a refinement, the metal parts 26, 28, and 32 which form the intake throat 36 and the mixing throat 38, may be formed to streamline these flow spaces.

Figure 2:
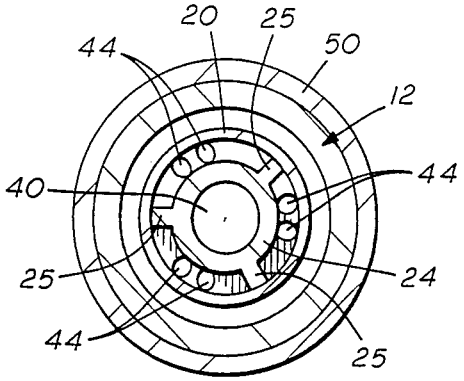
FIG. 2 is a cross-sectional view taken at 2—2 of FIG. 1 and showing the inlet ports as opening into the annular intake passageway.

A generally annular flow intake passageway 42 is defined with vanes 25 between the pump housing 20 and the discharge housing 24 which merges into the intake throat 36 at its upper end and is opened into a plurality of flow intake ports 44 at its lower end (FIG. 2). The flow intake ports 44 are defined within the cross-over housing 22 to open into the annular passageway 42 and to extend past the annular discharge chamber 41 into a generally cylindrical passageway 46 formed in the lower end of the cross-over housing in axial alignment with the pump body 16 (FIGS. 2, 3, and 4).

Figure 3:
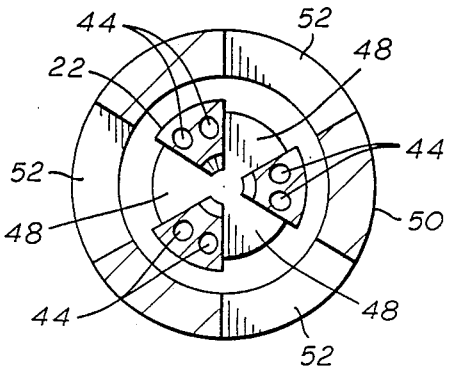
FIG. 3 is a cross-sectional view taken at 3—3 of FIG. 1 and showing the inlet ports and the housing window passageways formed by the cross-over member and the inlet ports formed in the cross-over housing.
Figure 4:
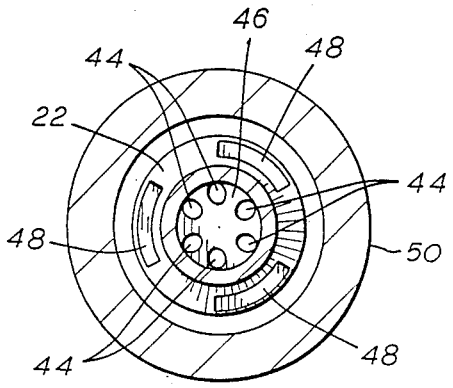
FIG. 4 is a cross-sectional view taken at 4—4 of FIG. 1 and looking upwardly to show the flow inlet ports as opening into the cylindrical inlet passageway formed by the cross-over housing to receive well fluids.

A plurality of housing window passageways 48 are formed by the cross-over housing 22 to open up the diffusion bore chamber 41 to outside the pump body 16 as shown in FIGS. 1 and 3. The cross-over body or housing 22 is adapted to be received at its lower end within a bore defined within the tubing seating collar 50 in sealed relationship provided by a tapered end 76 fitted within a socket 78. The seating collar 50 defines a plurality of tubing window passageways 52 (FIG. 3) which provide large flow openings between the housing window passageways 48 and the annulus 54 between the tubing 12 and the casing 14.

High pressure liquid is pumped down the tubing 12 to pass through the injection bore 30 of the injector nozzle 28 at high velocity. The size of the injection bore 30 is designated as a function of the pressure and volume of the pumped hydraulic liquid. The mixing bore 34 of the mixing tube 32 is commensurately larger to accommodate both the liquid forced through the injector bore 30 and the well production liquid entrained through the intake throat 36 and mixing throat 38 by the high velocity stream of pumped liquid.

The liquid discharge from the mixing bore 34 into the aligned diffusion bore 40 is of high velocity (though of lower velocity than the liquid passing through the injector bore 30). As the liquid enters into the diffusion bore 40, the linearly increasing diameter of the bore 40 causes a corresponding decrease in velocity of the liquid such that the liquid enters the discharge chamber 41 at a sufficiently low velocity to easily pass through the cross-over window passageways 48 with negligible pressure drop.

The liquid passing through the window passageways 48 passes on out of the tubing 12 through the passageways 52 at the continued low velocity and negligible pressure drop. Once in the tubing casing annulus 54, the produced liquid is forced on to the earth's surface in the usual fashion.

It is to be noted that all the liquid which moves at the highest velocities flows through substantially cylindrical passageways, the gradually opening diffusion bore 40 and into the discharge chamber 41 on a straight line with substantial hydraulic efficiency. The pressure drop through these cylindrical bores may be calculated as a function of power fluid, the bore diameters, pressure, and flow rate.

The metal elements of the pump assembly 10 are desirably made of the steel or other alloys conventionally used for tools of this kind. The injector nozzle liner 28 and the mixing tube 32 are desirably provided of an erosion resistant metal such as tungsten carbide, for example.

OPERATION OF THE INVENTION

Figure 5:
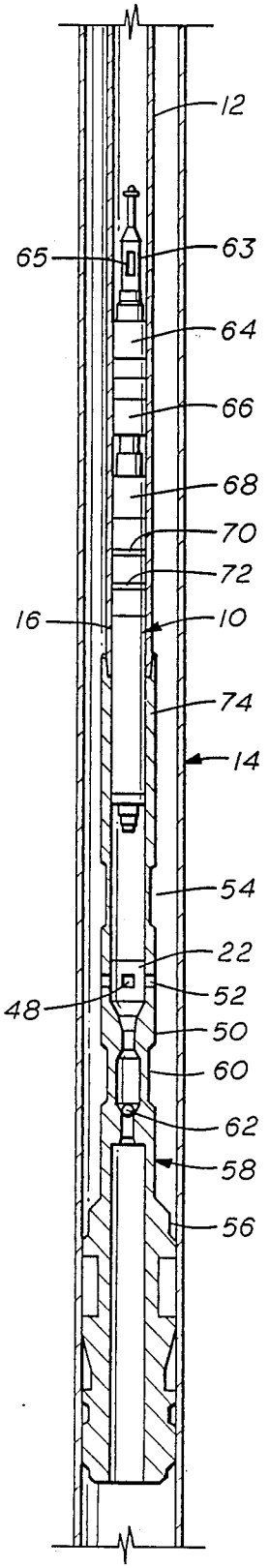
FIG. 5 is a longitudinal cross-sectional view showing a well tubing installed in a well casing with a production packer and a pumpdown downhole jet pump assembly as being pumped down the tubing into seating position.
Figure 7:
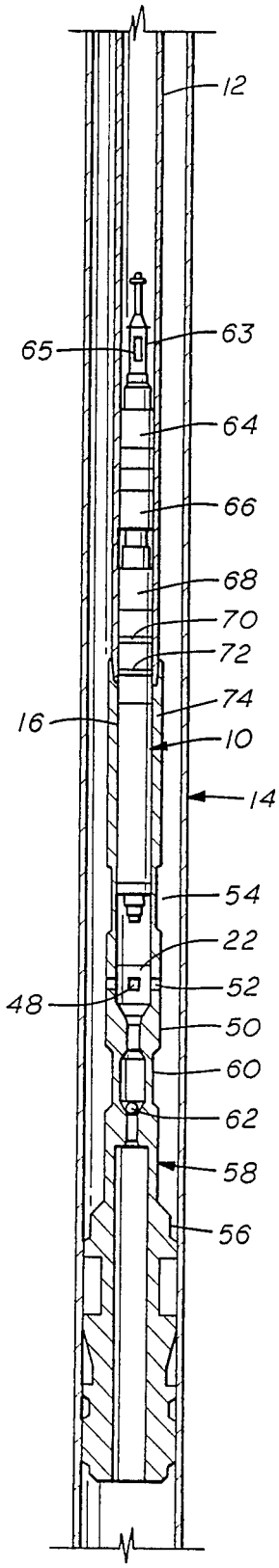
FIG. 7 is the same view as FIGS. 5 and 6 and showing the jet pump tool assembly being pumped upwardly from the seated position toward the earth's surface.

Referring now to FIGS. 1, 5, and 7, in a well utilizing the present invention, the tubing 12 is connected at the earth's surface to a high pressure hydraulic pump (not shown) which serves to provide a high pressure, high volume stream of power fluid down the tubing. The annulus 54 between the tubing 12 and the casing 14 is connected at the earth's surface through appropriate piping (not shown) which connects the produced liquid from the well into tanks or other piping.

The production packer 56 is set in the casing 14 at a depth above the producing formation and generally below the level of the liquid naturally produced from the formation into the bore of the well casing 14. The tubing 12 is equipped with the jet pump receiving assembly 58 which is connected into the production packer 56 by a stinger or the like (not shown) so that the tubing assembly may be withdrawn for repair or servicing as appropriate.

The jet pump assembly 10 is then inserted in the tubing at the top of the well at the earth's surface and the piping connected together to permit pumping of the assembly 10 down through the tubing with the pressure of the liquid being pumped being confined to drive the assembly by the upward facing pump cup 64. The pump assembly 10 is pumped down into the position where the cross-over housing 22 is seated in the cross-over receiving collar 50 as shown in FIGS. 1 and 6. While there is some flow through the tool as the tool assembly is being pumped down (as permitted by the jet injection bore 30), the flow rate of the pump is such that this flow is not large enough to hinder the travel of the pump assembly 10.

In operation after the pump assembly 10 seated, as described, liquid flow under high pressure is pumped down through the tubing 12, the injection orifice 30 and on through the mixing bore 34 and the diffusion bore 40. The produced liquid within the well flows into the chamber 46 past the foot valve 62 through the inlet ports 44, through the annulus 42, and into the intake throat 36 and mixing throat 38 where it is entrained by the high velocity flow through the bore 30 into a mixing relationship within the bore 34.

The combined power liquid and pumped production liquid is mixed within the mixing bore 34 and travels into the diffusion bore 40 wherein the velocity of the combined fluids gradually diminish with commensurate increase in pressure. The lower velocity liquid is then passed into the chamber 41 and out through the cross-over window passageways 48 with little further pressure drop. The combined liquid flowing out through the relatively large windows 48 pass immediately through the large windows 52 into the annulus 54 between the tubing 12 and the casing 14. The pressure of the combined power fluid and produced liquid carries the liquid thereon up through the annulus 54 to the earth's surface as previously described.

When removal of the jet pump assembly 10 is desired, pressure is applied by the pump at the earth's surface down through the annulus 54 which enters into the tubing through the windows 52 to be imposed on the cross-sectional area of the tool as defined by the seal rings 70 and 72 within the seal collar 74. This applied pressure forces the pump assembly 10 upwardly until the seals 70 and 72 are no longer in sealing contact with the seal collar 74. The lower cup 66, which faces down, then receives the pressure of the fluid flowing past the seal 70 and 72 and thereon carries the pump assembly 10 up through the tubing 12 to the earth's surface where it is received into a catching device (not shown) which latches onto the fishing neck 65. The pump assembly 10 is thereon removed from the piping for repair or other appropriate operations.

Such removal operation is best shown in FIG. 7.

It is to be noted that changes and modifications may be made to the embodiment as herein shown and described without departing from the spirit of the invention has come within the purview and scope of the appended claims.

What is claimed is:

1. In a jet pump adapted for connection into well tubing to produce fluids produced into a well casing, the combination comprising:

(a) an elongated pump body comprising a jet nozzle carrier, a generally tubular pump housing, and an elongated flow cross-over housing connected in threaded connection;

(b) a generally tubular flow discharge housing connected within said pump housing to extend from said cross-over housing to near said nozzle carrier;

(c) injector nozzle means for receiving a power fluid flowing downward through said housing and injection nozzle means including a nozzle liner having a cylindrical injection bore connected to said nozzle carrier and axially downwardly directed into said discharge housing;

(d) a mixing tube having a cylindrical mixing bore of larger internal diameter than said injection bore connected to said flow discharge housing in axial alignment with said injection bore;

(e) a frusto-conical funnel shaped flow intake and mixing throat formed by the outlet of said injection nozzle and the inlet of said mixing tube and merging with said mixing tube bore into a common passageway;

(f) a diverging pressure recovery diffusion bore formed within said discharge housing and extending in axial alignment between said mixing bore and a discharge chamber formed within said cross-over housing;

(g) an axially disposed annular intake chamber defined between said pump housing and said discharge housing and extending into said intake and mixing throat;

(h) a plurality of intake ports formed within said cross-over housing, said intake ports opening into said annular intake chamber and generally extending circumferentially around and linearly past said discharge chamber into a generally cylindrical passageway formed by said cross-over housing in axial aligment with said discharge housing;

(i) a plurality of housing window passageways formed by said cross-over housing between said intake ports to freely open said diffusion bore through said discharge chamber to outside said pump body;

(j) said cross-over housing being adapted to be received into a tubing seating collar connected into said well tubing, said seating collar defining a plurality of tubing window passageways in substantial alignment with and providing an opening between said housing window passageways and the annulus between said tubing and said well casing.

2. The combination of claim 1 wherein the length of said mixing bore is a function of its internal diameter and the internal diameter of said injection bore.

3. The combination of claim 1 wherein the axial and linear alignments of the flow bores and ports of said jet pump are selected to provide optimum pumping efficiency.

4. The combination of claim 1 wherein the space defined as said intake and said mixing throat is streamlined.

5. The combination of claim 1 wherein said nozzle liner and said mixing tube are formed of an erosion resistant material.

6. The combination to claim 5 wherein said erosion resistant material is tungsten carbide.

7. A jet pump comprising:

(a) an elongated body, a jet nozzle carrier, a generally tubular pump housing, and an elongated flow cross-over housing connected in threaded connection;

(b) a generally tubular flow discharge housing connected within said pump housing to extend from said cross-over housing to near said nozzle carrier;

(c) injector nozzle means for receiving a power fluid flowing downward through said housing, said injection nozzle means having a cylindrical injection bore connected to said nozzle carrier and axially downwardly directed into said discharge housing;

(d) a mixing tube having a cylindrical mixing bore connected to said flow discharge housing in axial alignment with said injection bore;

(e) a funnel shaped flow intake throat formed by the outlet of said injection nozzle and the inlet of said mixing tube;

(f) a frusto-conical mixing throat formed by the inlet of said mixing tube and merging said intake throat and said mixing tube bore into a common passageway;

(g) a diverging pressure recovery diffusion bore formed within said discharge housing and extending in axial alignment between said mixing bore and a discharge chamber formed within said cross-over housing;

(h) an axially disposed annular intake chamber defined between said pump housing and said discharge housing and extending into said intake and mixing throat;

(i) a plurality of intake ports formed within said cross-over housing, said intake ports opening into said annular intake chamber and generally extending circumferentially around and linearly past said discharge chamber into a generally cylindrical passageway formed by said cross-over housing in axial alignment with said discharge housing;

(j) a plurality of housing window passageways formed by said cross-over housing between said intake ports to freely open said diffusion bore through said discharge chamber to outside said pump body;

(k) said cross-over housing being adapted to be received into a tubing seating collar connected into said well tubing, said seating collar defining a plurality of tubing window passageways in substantial alignment with and providing an opening between said housing window passageways and the annulus between said tubing and said well casing.

8. The jet pump of claim 7 wherein said nozzle liner and said mixing tube are formed of an erosion resistant material.

9. The combination of claim 8 wherein said erosion resistant material is tungsten carbide.

10. The combination of claim 9 wherein the internal diameter of said mixing bore is a designated function of the internal diameter of said injection bore.

11. The combination of claim 10 wherein the axial and linear alignments of the flow bores and ports of said jet pump are selected to provide optimum pumping efficiency.

12. The jet pump of claim 11 wherein the space defined as said intake throat and said mixing throat is streamlined.

* * * * *